United States Patent [19]

Crowley

[11] Patent Number: 4,547,658

[45] Date of Patent: Oct. 15, 1985

[54] MULTIPLE HEAT FUSING WIRE CIRCUIT FOR UNDERBLANKETS

[75] Inventor: George C. Crowley, Glenview, Ill.

[73] Assignee: Sunbeam Corporation, Oak Brook, Ill.

[21] Appl. No.: 620,360

[22] Filed: Jun. 13, 1984

[51] Int. Cl.[4] ..... H05B 3/02

[52] U.S. Cl. ..... 219/539; 219/212; 219/505; 219/528; 219/549; 219/494

[58] Field of Search ..... 219/211, 212, 345, 494, 219/504, 505, 517, 528, 539, 548, 549, 544, 552, 553; 337/414, 415

[56] References Cited

U.S. PATENT DOCUMENTS

| | | | |
|---|---|---|---|
| 2,846,560 | 8/1958 | Jacoby et al. | 219/212 |
| 3,493,727 | 2/1970 | Hosokawa et al. | 219/505 |
| 3,591,765 | 7/1971 | Owers | 219/212 |
| 3,628,093 | 12/1971 | Crowley | 219/212 X |
| 3,814,899 | 6/1974 | Gordon, Jr. et al. | 219/212 |
| 4,034,185 | 7/1977 | Crowley | 219/212 |
| 4,251,718 | 2/1981 | Cole | 219/501 |
| 4,278,874 | 7/1981 | Cole | 219/505 |
| 4,503,322 | 3/1985 | Kishimoto et al. | 219/505 |

FOREIGN PATENT DOCUMENTS

| | | |
|---|---|---|
| 1155118 | 6/1969 | United Kingdom . |
| 1456684 | 11/1976 | United Kingdom . |
| 2028607 | 3/1980 | United Kingdom . |
| 1585921 | 3/1981 | United Kingdom . |
| 1588783 | 4/1981 | United Kingdom . |
| 1588784 | 4/1981 | United Kingdom . |

*Primary Examiner*—Volodymyr Y. Mayewsky
*Attorney, Agent, or Firm*—Neil M. Rose; Clifford A. Dean

[57] ABSTRACT

A heating cable for use with an electric underblanket the cable being of the type in which a sensor wire is employed coextensive with a heater wire and separated by a layer of meltable insulating material so that overheat conditions are sensed by contact between the sensor wire and the heater. A number of helically wound coextensive wires cooperate with switching means to provide overheat temperature sensing at various wattage levels of heating.

20 Claims, 7 Drawing Figures

MULTIPLE HEAT FUSING WIRE CIRCUIT FOR UNDERBLANKETS

BACKGROUND OF THE INVENTION

The present invention relates generally to electric heating elements and, more specifically, to flexible heating cables which may be used in heating pads and electric bed covers.

In almost any type of electrically heated pad or bed covering, it is necessary to provide means to protect against dangerous overheat conditions. Many different types of thermostats and sensors are used for this purpose. One common approach which has been used for years in connection with heating wires or cables for use in underblankets involves an electric heating element which is provided with a coextensive heating or sensing wire separated from the other heating element by an insulating layer of meltable plastic, The plastic is selected so that it softens or melts and permits contact or at least a low resistance path between the two coextensive wires whenever there is an undesired rise in the temperature along the heating cable. The coextensive wires are typcially connected so that in the event there is a short circuit or high current flow between the wires, the resulting increased current flow will interrupt the power circuit to the heating element. This type of heating cable is described in my U.S. Pat. No. 3,628,093 and in the U.S. Pat. No. 3,591,765 to Owers.

One of the problems encountered in heat sensing circuits of the type disclosed in my eariler patent is the problem of providing switching means which will disable the circuit regardless of where along the length of the heating element wire the fault occurs. It can be readily understood that if the fault occurs at the end of the cable adjacent a common connection between the two coextensive wires, there will be little or no voltage drop to produce a current within the sensing circuit. Various approaches have been followed to overcome this problem. In general, such approaches have involved tapping the heating element at the center to provide two sections of heating wire each with a sensing wire to obtain suitable voltage drops in each of the sections of sensing wire or have involved the use of diodes which permit one to sense the short circuit during one-half of the power cycle while delivering power to the heating element during the other half of the power cycle.

The U.S. Pat. No. 4,251,718 to Cole discloses various embodiments in which rectifiers are used to assure adequate current flow through the sensing wire circuit regardless of where the fault occurs along the length of the heating wire. There are many British Specifications which disclose variations of this use of the diode to provide a sensing portion of each cycle in which the current through the sensing wire may be used to trigger the switching means for the circuit. Among these are British Patent Specification No. 1,155,188 and No. 1,585,921. Other British Specifications involving the concept of dividing the heating element intermediate its ends into two sections each of which has a separate sensing wire and cross-connecting the sensing wires to obtain the desired voltage drop are shown in U.K. Patent Specifications No. 1,588,783, 1,588,784 and 2,028,607.

It has also been known in the art to provide combinations of dual wound coils with coextensive but spaced single wound coils as disclosed in British Specification No. 1,456,684. In the '684 specification, the coils in the dual wound portion serve as a heater and are separated by a meltable insulating layer which, in the event of an overheat condition, the short circuit between the elements increases the current to blow a fuse and disable the circuit.

It has also been known in the art to employ dual element sensing wires of dual element heating wires which are wound coaxially on a single core. This type of construction is shown in the U.S. Pat. Nos. 2,846,560 to Jacoby et al and 3,493,727 Hosokawa et al.

SUMMARY OF THE INVENTION

The present invention involves use of a heating cable which employs at least three separate helically wound conductors which are connected in circuit by switching means which provide multiple wattage levels in which various of the wires are employed as heater and/or sensors there being meltable insulation layers between the various helically wound wires. In one disclosed embodiment of the invention, the three element wires are alternatively used as heaters with either one or two of the wires serving as sensors at selected wattage levels. A multiple pole switch is employed to switch the various heating elements in circuit and to connect a sensor wire or wires appropriately with each of the heating element combinations. By providing the three coextensive element wires, the problems of the prior art involving obtaining sufficient voltage drop to produce an easily sensed current is overcome as a consequence of two or three element wires shorting out together or cooperating to produce an easily sensed current increase in the event of an overheat condition.

The cable itself may take several different forms, the only requirement being the three element wires all be separated from each other by the meltable insulating material so that when an overheat occurs two or more wires may short together. In one form the element wires are disposed one over the other each in a helical wind with the direction of the helices in each adjacent element wire being opposite to the other adjacent helically wound element wire. In another embodiment, one of the element wires is wound on a core and a bifiler or twin lead conductor having meltable insulation is wound over the element carried by the core with the initial element being wound in one direction and the bifiler wire being wound in the opposite direction to assure good contact between the three wires in the event of an overheat melting the insulation.

Accordingly, it is an object of the present invention to provide an improved electric blanket heating cable having a plurality of heating element and sensor wires wound helically on a common axis and provided with switching means to connect said wires in various combinations to achieve variable wattage operation.

A further object of the present invention is to provide an improved electric blanket heating and sensing cable having at least three coextensive heating and sensor wires spaced apart by meltable layers so that two or three engage each other in the event of an overheat condition.

Another object of the present invention is to provide an improved heating means for an electric blanket or heatng pad having a heating cable with at least three coextensive wires separated be meltable plastic material and having switching means to connect said wires to a source of power whereby various wattage levels may be achieved and overheat conditions may be sensed by current through a sensor wire in intimate association with said heating wires.

Further objects and advantages will become apparent as the following description proceeds and the features of novelty which characterize the invention will be pointed out in the claims annexed to and forming a part of the sepcification.

DESCRIPTION OF THE PREFERRED EMBODIMENT

Figure 1:
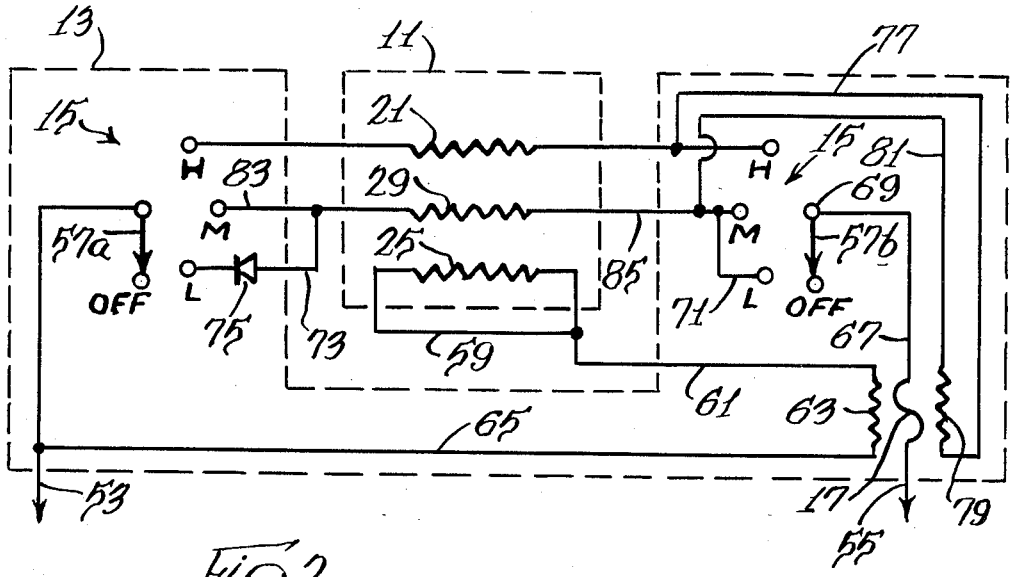
FIG. 1 is a schematic diagram of the circuit for my improved heating and sensing cable and the switching means associated with it.

Referring to FIG. 1, there is shown a schematic diagram showing my invention which includes a novel heating and sensing cable 11 which is associated with a control module 13 which is made up of a multiple pole, multiposition switch 15 and a thermally responsive switch or fuse 17. To best understand the operation of the heating and sensing cable 11 and the control module 13 reference should be made to FIG. 2 which illustrates the details of the heating and sensing cable 11.

Figure 2:
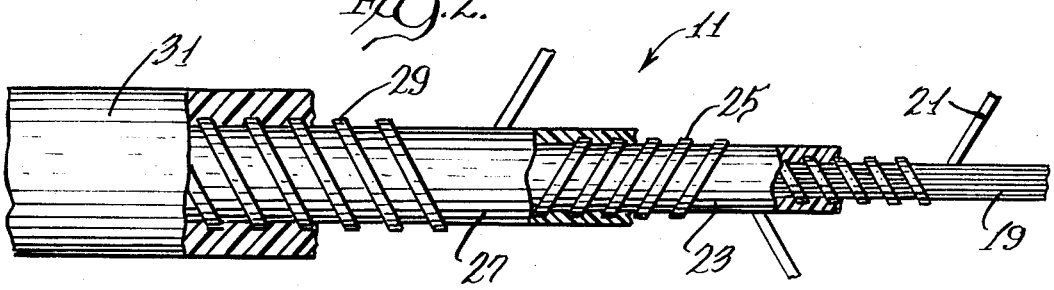
FIG. 2 is a fragmentary partially cutaway view of a preferred embodiment of the heating and sensing cable of my invention.

An enlarged fragmentary section of the heating and sensing cable 11 is shown in cutaway form in FIG. 2. It should be appreciated that the cable 11 is designed to be disposed in a blanket or heating pad with the cable being snaked through tortuous passegeways in a fabric blanket shell or heating pad so as to cover the entire surface area of the blanket or pad and deliver heat thereto in a manner well-known in the art. The cable 11 is of the type in which it heats throughout its length and also has built into it means for sensing overheat conditions that might occur over the length of the cable 11. The overheat sensing is by means of a meltable electrically insulating layer which separates a sensing wire from a heating element, the insulating layer being such that an overheat temperature softens or melts the insulating layer. This condition allows the adjacent wire to move into contact whereby the sensing element is shorted out to the heating element and external circuit means sense the circuit conditions resulting from the short and disconnect the heating element from the circuit.

The cable 11 includes a multi-fiber insulating core 19 which may be made up of thin nylon or rayon strands to form a cylindrical core of between 0.025 and 0.029 inches in diameter. Upon this core 19 there is wound a ribbon of resistance wire 21 over which there is extruded a cylindrical layer 23 of polyvinyl chloride having a melting temperature of approximately 250° F. Wound on the meltable layer 23 is a second resistance wire 25 which is helically wound in the opposite direction from the wire 21 as is evident from the drawing.

Extruded over the element wire 25 is a second layer 27 of meltable material such as polyvinyl chloride on which a third element wire 29 is helically wound. The wire 29 is covered by an insulating layer 31 which may also be of a polyvinyl chloride material.

Figure 4:
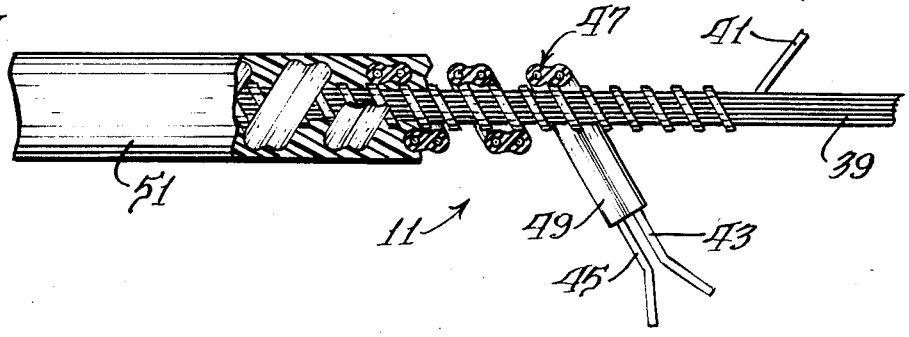
FIG. 4 is an alternative embodiment of the sensing cable of my invention.

The alternative cable construction disclosed in Fig. 4 utilizes a core 39 on which is wound the first element wire 41. There is then provided a second element wire 43 and a third element wire 45 which are extruded in a bifiler or twin conductor wire 47 including an insulation envelope 49 made of meltable polyvinyl chloride and having a somewhat dog-bone shaped cross-section. The bifiler wire 47 is wound on top of the helical wire 41 in the reverse helical direction to assure that in the event of an overheat condition, the element wires 43 and 45 will engage the element wire 41 and will not be lined up between the adjacent turns. The assembly including the bifiler wire 47 wound on the wire 41 and core 39 are covered by an insulating jacket 51 which may again be made of a polyvinyl chloride material.

Referring again to FIG. 1, we note that the element wires shown in the shcematic diagram as included in the cable 11 are identified as element wires 21, 25 and 29 as described earlier in connection with the cable shown in FIG. 2. No attempt has been made to show the extent of the cable 11 recognizing that those skilled in the art would appreciate that an underblanket or heating pad would have quite different lengths of such cable disposed tortuously throughout the surface of the underblanket or heating pad. The heating and sensing cable 11 and control module 13 are provided with conductors 53 and 55 which may be in the form of a dual conductor cord suitable for plug-in connection to a household outlet. The switch 15 is a two pole, four position switch which is movable to any position from off to low to medium to high there being two movable contact members 57*a* and 57*b* which are shown in FIG. 1 in their off position and which are tied together to move in unison between the various switch positions.

It should be appreciated that in the embodiment of FIG. 1, the element wire 25 function as an overheat sensor in all of the various switch positions to be described in detail. For this reason, the opposite ends of the wire 25 in the cable 11 are connected by a conductor 59 which in turn is connected by a conductor 61 through a resistance 63 conductor 65 and one side of the power supply represented by conductor 53. The connection together of the ends of wire 25 by the conductor 59 provides an arrangement where a single break in wire 25 would not disable it as a sensor for overheat conditions in the cable 11. The resistance 63 is in good heat exchange relationship with the thermal fuse 17 so that current passing through conductor 61, the resistor 63 and the conductor 65 will heat the fuse 17 causing the circuit to the cable 11 to be opened.

Tracing the circuit when the switch 15 is in the low position, we note that there is a conductor 67 which connects the fuse 17 to a common terminal 69 and the aforedescribed switch arm 57*b* which in the low position provides current to a conductor 71 which is connected to one end of the element wire 29. The other end of the element wire 29 is connected to a conductor 73 through a half-wave rectifier 75 to the low wattage terminal through the switch arm 57*a* to the line 53. Thus, when the switch 15 is in the low wattage setting, the element wire 29 is across the line in series with a rectifier 75 which provides half-wave power to the element wire 29.

In the low wattage position of the switch 15, element wire 21 of the cable 11 also serves as a sensing wire as does the element wire 25. To accomplish this sensing function, the element wire 21 has its right end as shown in FIG. 1 connected by a conductor 77 through a resistance 79 to a conductor 81 which in turn is connected to the low wattage terminal on the switch 15 through the conductor 71. An analysis of the circuit shows that there is one sensor wire 25 which is connected through resistance 63 to line 53 of the power supply while the sensing wire 21 is connected to the other side of the line represented by conductor 55. As will be understood by one skilled in the art, a short or overheat condition appearing at the left end of the cable 11 as shown in FIG. 1 will be sensed by the sensor wire 21 which will essentially have the line voltage applied across the resistor 79 since it is high in value as compared to the reistance of the element 21. On the other hand, an overheat or fault occurring at the right hand end of the cable 11 results in the line voltage being applied across the resistance 63 which again produces sufficient current flow to cause the fuse 17 to blow, thereby interrupting the power to the cable 11. An overheat or fault occuring anywhere else in the length of the heating cable will have anywhere between ½ to full line voltage across it which will cause sufficient current flow to cause the fuse 17 to blow, thereby interrupting the power to the cable 11.

In the medium wattage setting of the switch 15, the circuit functions in substantially the same manner as described above in connection with the low wattage setting except for the fact that the switch arm 57*a* connects the power supply line 53 to conductor 83 which connects directly to the element wire 29 bypassing the rectifier 75 and providing twice the wattage at the medium setting as at the low setting. The right end of the element wire 29 is connected by a conductor 85 through the switch arm 57*b* to conductor 67 and the line 55 through fuse 17. Therefore, in the medium wattage setting, the sensor wires 21 and 25 function in the same manner as described above in the low wattage setting insofar as the current through resistors 63 and 79 are effective to blow the fuse 17 and open the circuit to the cable 11 in the event of overheat conditions at either of the ends of the cable 11 or any place in between the ends. In the high wattage setting of the switch 15, the element wire 21 is the heating element and the element wires 25 and 29 are the sensor wires. Sensor 25 functions as described above in sensing shorts at the right hand end of the heating element 21 while the sensor 29 functions to sense shorts at the left hand end of the heating element 21. The only difference between the medium and high settings is the reversal between element wires 21 and 29 as to which is the sensor wire and which is the heating element and the fact that the sensing current will be flowing in the opposite direction in the resistance 79 and its associated conductors connecting it to the ends of the element wires 21 and 29. The foregoing circuit provides a very simple and effective means of providing a multiple heat circuit for an electric underblanket or heating pad of the type having a fusible wire sensor.

Figure 3:
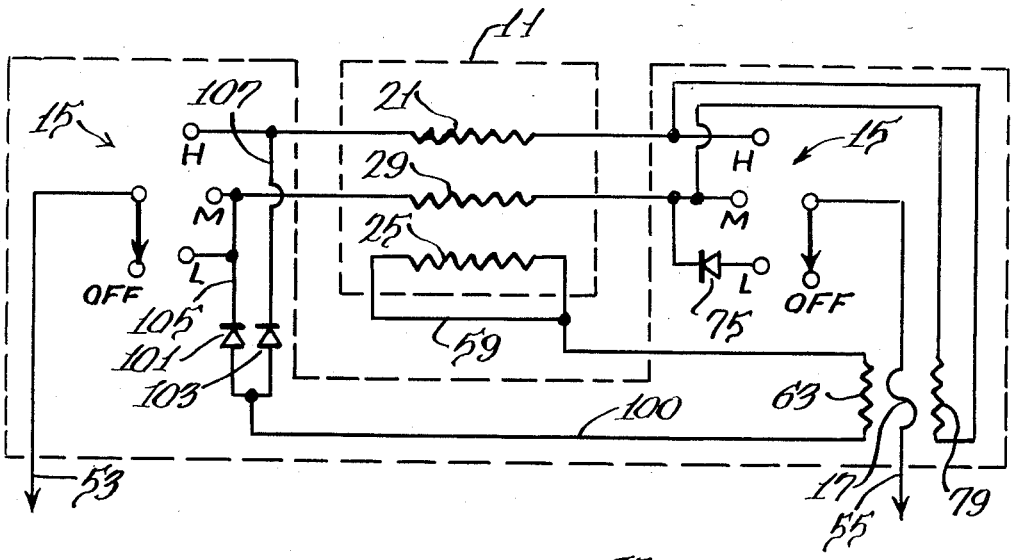
FIG. 3 is a schematic diagram of an alternative circuit embodying my invention.

The alternative embodiment shown in FIG. 3 is similar in function and structure to the embodiment of FIG. 1 having the same two pole, four position switch 15 and the three element wires 21, 25 and 29 in the cable 11 with the wire 25 acting as a sensor in all instances with its opposite ends connected by a conductor 59. The main difference between the two circuits relates to the manner in which the sensing wire 25 is connected through the resistor 63 to the side of the line 53 away from the fuse 17. In the embodiment of FIG. 1, the resistor is connected directly to line 53 by conductor 65. In the embodiment of FIG. 3, there is provided a conductor 100 which is connected to a pair of half-wave rectifiers 101 and 103. The half-wave rectifier 101 is connected by a conductor 105 to the left end of the element wire 29 while the rectifier 103 is connected by a conductor 107 to the left end of the element wire 21. The purpose of the rectifiers 101 and 103 is to prevent the sensor wire 25 from being operative when the side of the line represented by conductor 53 is on its positive cycle and restricting the funcitoning of the sensing wire 25 to the portions of the cycle when the side of the line represented by conductor 55 is positive. As a consequence, the sensor wire 25 responds only on the portion of the cycle in which the conductor 55 is positive while the sensor wire 21 will be effective to respond on both halves of any power cycle. Except for the above-described differences, the sensor wire 25 and the wire 21 will function to sense overheat conditions during the low and medium wattage operation and sensor 25 and wire 29 will function to sense overheat conditions at the high wattage operation in the same manner as in the embodiment of FIG. 1. It is noted that in FIG. 3, the rectifier 75 is operative to reduce the wattage at the low switch setting as in the embodiment of FIG. 1, the only difference being that in FIG. 3 the position of the rectifier 75 is at the other end of the element 29.

FIG. 4 is an alternative embodiment of the cable 11 as indicated above. The embodiment of either FIGS. 2 or 4 would be suitable for use in either of the embodiments as illustrated by the schematic diagrams of FIGS. 1 and 3. In the case of the embodiment of FIG. 4, the innermost wire 41 would serve as the sensor wire or the element wire 25 as shown in the embodiments of FIGS. 1 and 3. The other two wires, 43 and 45, would be connected as in the case of the element wires 21 and 29 described above.

Figure 5:
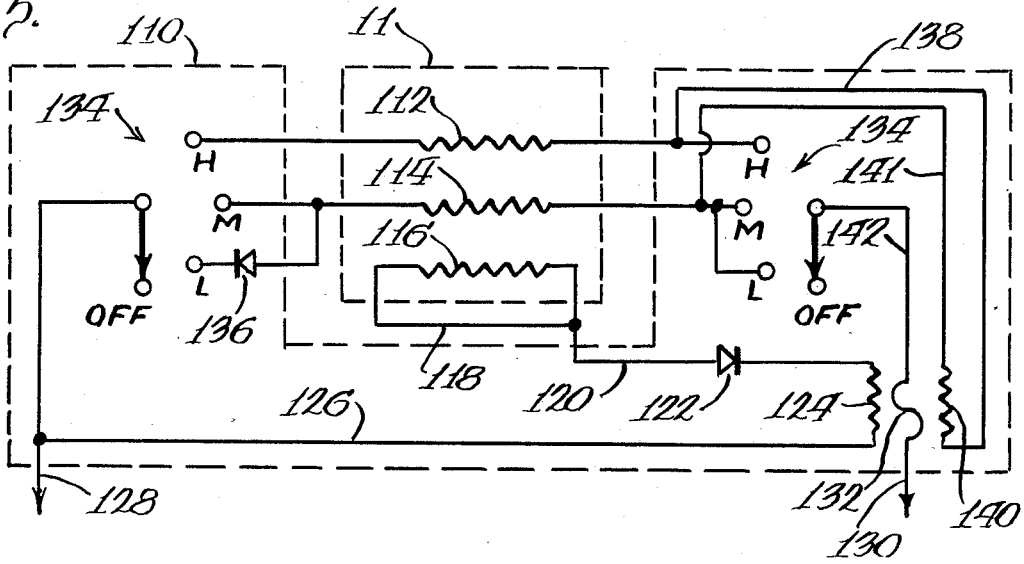
FIGS. 5, 6 and 7 are schematic diagrams of alternative embodiments of my invention.

Turning now to the embodiment of FIG. 5, there is shown schematically, cable 11 and a control module 110. The cable 11 includes three coextensive element wires 112, 114 and 116 which are wound in the configuration of either that shown in FIG. 2 or in FIG. 4. Wire 116 represent a sensor wire having its opposite ends interconnected by a conductor 118 and is connected by a conductor 120 through a half-wave rectifier 122 to a resistor 124 which is then connected by a conductor 126 to one conductor 128 of a power supply, the other side of to line being designated as 130. The resistor 124 is in good heat exchange relationship with a fuse 132 which is connected between the power supply line 130 and the cable 11.

The control module 110 includes a two pole, four position switch 134 which serves to connect the supply line to various ones of the wires 112, 114 and 116. In the low wattage position, the wire 114 is connected through a half-wave rectifier 136 which is connected to the left end of element wire 114. In the low wattage position, the sensor wire 116 as well as the wire 112 function to sense overheat conditions. The right end of the element wire 112 is connected by a conductor 138 through a resistor 140 to a conductor 141 which connects through the switch 134 to the fuse 132. Thus, in the low wattage setting of the switch 134, the sensing element 116 senses overheat conditions at the right half of the cable 11 while the element wire 112 senses overheat conditions that occur in the left half of the cable 11. In either of these instances, the current through the resistances 124 or 140 will produce sufficient heat to blow the fuse 132 to open the circuit to the cable 11.

In the medium wattage setting of the switch 134, the wires 116 and 112 will serve to sense the overheat conditions in the same manner as described above in connection with the low wattage switch setting, the only difference being that in the medium wattage switch setting, the half-wave rectifier 136 is bypassed in the power connection to the element wire 114.

In the high wattage setting of the switch 134, the element wire 114 serves as a sensor wire. This is accomplished by virtue of the conductor 141 which extends from the right end of the element wire 114 and interconnects it through resistance 140 through conductor 138 and switch 134 to the side of the line fed by conductor 130. Thus, the wire 114 acts as a sensor to sense overheat conditions in the left end of the cable 11 causing current flow through the resistance 140 to blow the fuse 132 while the senaor wire 116 would performs similarly to sense overheat conditions in the right end of the cable 11 producing a current flow in the resistance 124 which would blow the fuse 132.

Figure 6:
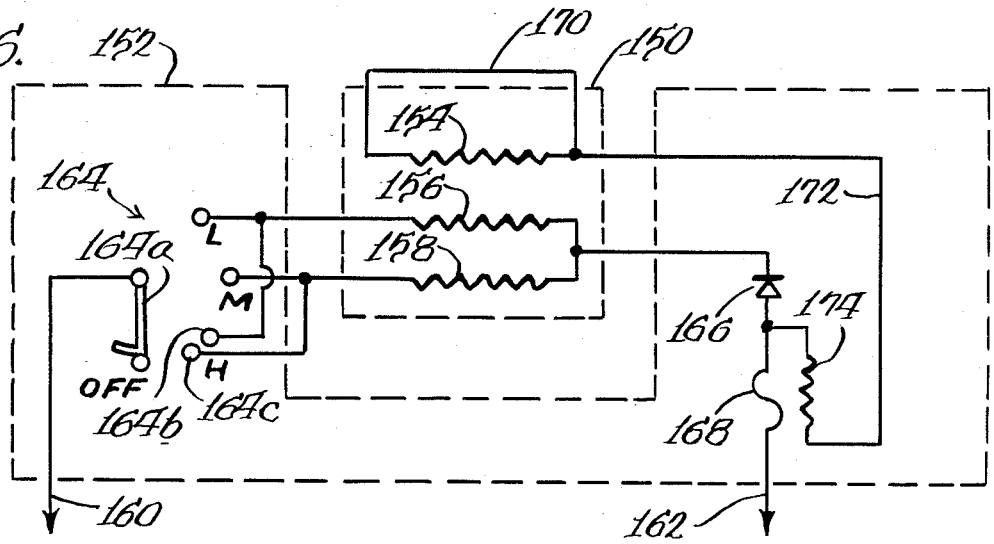
Figure 7:
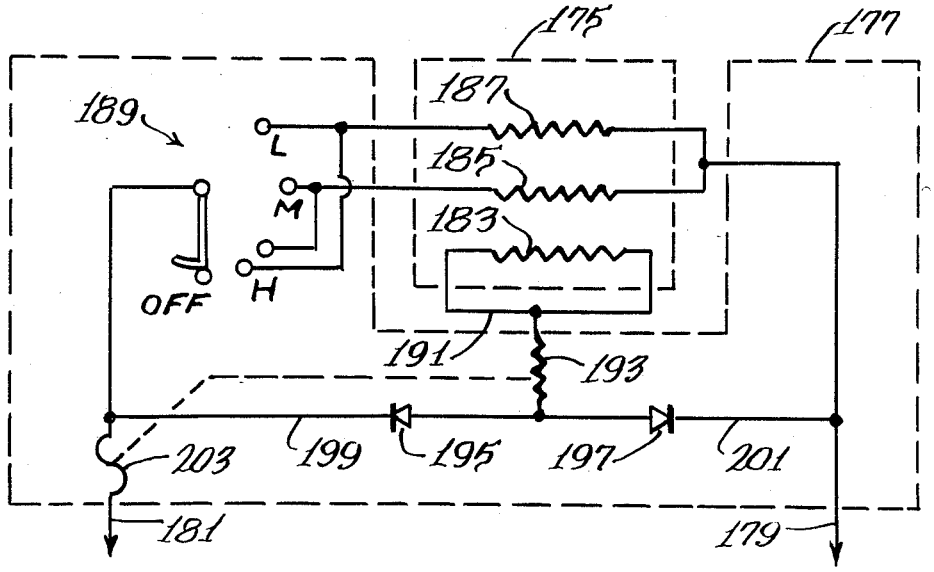

The embodiments of FIGS. 6 and 7 are somewhat different from the embodiments of FIGS. 1, 3 and 5 in that they both use a single sensor rather than the two sensing wires common to the earlier embodiments. However, the embodiments of FIGS. 6 and 7 are similar in that they use the same type of cable employing three conductor wires which are separated by meltable layers of insulation. The embodiment of FIG. 6 includes a heating and sensing cable 150 and a control module 152. The cable 150 may correspond in structure to the cable shown in detail in FIGS. 2 and 4 and includes a first sensor wire 154, a heater wire 156 and a second heater wire 158. The control module 152 is supplied with power through lines 160 and 162 which may comprise a conventional two conductor cord. The power supply line 160 is connected to a switch 164 which has a movable conducting arm **164*a* which is movable between an off position, a low wattage position, a medium wattage position and a high wattage position in which it bridges a pair of contacts 164*b* and 164*c*. In the low wattage position, the heater 156 is connected across the power supply through a half-wave rectifier 166 and a thermal fuse 168. In the medium wattage position, the element wire 158 is connected across the power supply line through the half-wave rectifier 166 and thermal fuse 168. The resistance of the element 156 is substantially greater than the resistance or wire 158 so that substantially more wattage is delivered by the element wire 158 than the wire 156. In the high wattage position, the tow element wires 156 and 158 are connected in parallel across the power supply line through the rectifier 166 providing a further increase in wattage over the wattage delivered when only the wire 158** was connected across the line.

In order to sense overheat conditions in the cable 150, the sensor wire has both ends connected together by a conductor 170 and a conductor 172 that connects through a fuse 174 to the line between the fuse 168 and the rectifier 166. The purpose of the rectifier 166 is to provide assurances that the sensor wire 154 will be effective to sense overheat conditions regardless of the position of the overheat across the length of the cable 150. Thus, were it not for the rectifier 166, the sensor wire 154 would be incapable of sensing overheat or short circuit conditions occurring at the right hand end of the cable 150. However, with the rectifier 166 in the circuit, power is delivered to the heating wires 156 and/or 158 only during one-half the cycle and during the other half of the cycle, the full line voltage would appear between the sensor wire 154 and the wires 156 and 158. Therefore, in the case of an overheat producing a short circuit, there would be a substantial flow of current through the resistor 174 such that the fuse 168 would be blown, opening the power circuit to the cable 150.

The embodiment of FIG. 7 includes a heating and sensing cable 175 which may correspond in structure to the embodiments disclosed in detail in FIGS. 2 and 4 of the drawings. A control module 177 associated with the cable 175 includes power supply lines 179 and 181. The cable 175 includes a sensor wire 183 and heater wires 185 and 187. The heater wires 185 and 187 are connected across the line so as to be alternatively connected for low, medium and high wattage operation by a four position switch 189 which operates in a manner identical to the switch 164 as described in the embodiment of FIG. 6. Element wire 187 is the low wattage wire connected at the low wattage setting, element wire 185 is the medium wattage element and the two element wires 185 and 187 are connected in parallel for the high wattage operation. The sensor wire 183 has its ends connected by a conductor 191 which is connected through a resistor 193 to the junction of a pair of half-wave rectifiers 195 and 197. The rectifiers 195 and 197 are in turn connected by conductors 199 and 201, respectively, to the power lines 181 and 179. A thermal fuse 203 is positioned in the line 181 and is in good heat exchange relation with the resistor 193 so that current flow through the resistor 193 will interrupt the circuit by blowing the fuse 203. The half-wave rectiviers 195 and 197 are polarized so that there is no conduction toward the junction of the two rectifiers except the current which flows from the sensor wire 183 through the resistor 193 and to either side of the line. The three wire conductor described in detail above provides a simple and effective means for obtaining multiple wattage operation of a heating cable of the type having a sensor wire separated by a meltable insulating layer from the heater.

From the foregoing, it should be appreciated that the three wire cable disclosed in various form in FIGS. 2 and 4 is uniquely adapted to function as a heater and sensor in a multiple wattage heating pad or blanket. The cable provides a structurally simple arrangement which when combined with inexpensive switching means provides a combination which has the capacity for sensing overheat conditions regardless of where they occur over the length of the heating cable.

What is claimed as new and desired to be secured by Letters Patent of the United States is:

1. The combination comprising a cable having an elongated core of insulating material on which three coextensive and helically wound wires are disposed, said wires being separated by a meltable layer of insulating material which maintains said wires separated at normal operating temperatures and melts under overheat conditions permitting the wires to contact each other, means connecting said wires to a source of electric power whereby when one of said wires functions as a heating element at least one of the other two of said wires may function as a sensor element, means responsive to a reduction in resistance between said sensor element and the other of said wires to disable the power to said cable.

2. The combination of claim 1 wherein said connecting means comprises a switching means which is setable to any one of a plurality of switch positions in which heating elements of different wattage are connected to said power source, at least two of said wires functioning as heating elements at various of said switch positions.

3. The combination of claim 1 wherein said connecting means comprises a switching means which is effective to connect selected ones of said wires across said power source to operate as heating elements, said wires having different resistances to provide various different wattage levels at various selected settings of said switching means, at each of said selected settings at least one of said wires operating as a sensor.

4. The combination of claim 3 wherein said responsive means includes a fuse in series with said switching means, a resistance in series with each sensor element, each said fuse being responsive to current through said resistors to interrupt power to said heaters when there is an overheat condition causing melting of said layer.

5. The combination of claim 1 wherein said sensor element is connected through a resistor to the junction of two oppositely polarized rectifiers which are connected in series across said power source, a fuse connected in series with said cable, said resistor and said fuse being in good heat exchange relationship whereby an overheat condition in said cable produces a reduced resistance or short circuit current in said sensor element which heats said resistor causing said fuse to blow opening the circuit to said cable.

6. The combination comprising a cable having an elongated core on which three coextensive and helically wound wires are disposed, one of said wires being helically wound oppositely from the other two, said wires being separated by a meltable layer of insulating material which maintains said wires separated and insulated from each other at normal operating temperatures and melts under overheat conditions permitting two or three wires to contact each other, manually controlled switching means connecting said wires to a source of electric power whereby two of said wires may function as heating elements while the third of said wires functions as a sensor element, means responsive to a low resistance path between said sensor element and the other of said wires to disable the powerr to said switching means.

7. The combination of claim 6 wherein said wires include a sensor wire wound directly on said core and first and second heater wires wound in the opposite direction from said sensor wire on top of said sensor wire.

8. The combination of claim 7 wherein said first and second heater wires are electrically insulated from each other and from said sensor wire by a meltable insulation coating which surrounds and joins said first and second heater wires as an insulated twin conductor cord which is wound directly on said sensor wire, an insulating jacket extruded over said coating, said wires and said core to enclose and electrically insulate said wires.

9. The combination of claim 6 wherein said switching means includes a manually adjustable switch having three operative positions, said switch having a low wattage position in which a first one of said wires is connected to said power source and a medium wattage position in which a second one of said wires is connected to said power source and a high wattage position in which said first and second wires are connected in parallel to said power source, a half-wave rectifier and a thermal fuse connected in series with said wires in any of said switch positions, a third one of said wires being a sensor wire having both ends connected together and to a resistor in good heat exchange relation to said fuse whereby a reduced resistance or short circuit between said sensor wire and said first and second wires cause said fuse to open the circuit to said cable.

10. The combination of claim 8 wherein said switching means includes a manually adjustable switch having three operative positions, said switch having a low wattage position in which a first one of said wires is connected to said power source and a medium wattage position in which a second one of said wires is connected to said power source and a high wattage position in which said first and second wires are connected in parallel to said power source, a half-wave rectifier and a thermal fuse connected in series with said wires in any of said switch positions, a third one of said wires being a sensor wire having both ends connected together and to a resistor in good heat exchange relation to said fuse whereby a reduced resistance or short circuit between said sensor wire and said first and second wires cause said fuse to open the circuit to said cable.

11. The combination of claim 10 wherein said sensor wire is connected through said resistor to the power source whereby said half-wave rectifier is between the connection and said heating wires.

12. The combination of claim 6 wherein said switch means provides a plurality of different selectable wattage levels when said cable is connected to said power source, only one of said wires functions as a heating element and the other two function as sensing elements at any selected wattage level for said switch means, said switch means at any selected wattage connectng one sensing wire to one side of the power source and one sensing wire to the other side of the power source.

13. The combination of claim 12 wherein said means responsive to a reduced resistance comprises a thermal fuse connected in series with said cable, a pair of resistances each connected in series with one of said sensing wires at any selected wattage, said resistances being in good heat exchange relation with said fuse to open said fuse whenever a short circuit occurs in the portion of the cable to which such sensor wire responds.

14. A heating cable for use in heating pads, underblankets and overblankets comprising an insulating stranded flexible core, a first wire helically wound on said core, second and third wires spaced from each other and helically disposed around said first wire, a first coating of meltable insulating material surrounding said second and third heater wires to maintain them is spaced relation to each other and with respect to said first wire, a jacket of insulating material enclosing said wires and said coating of insulating material, said first wire contacting either said second wire or third wire or both in the event of an overheat condition in which the temperature of said cable exceeds the melting temperature of said coating of insulating material.

15. The heating cable of claim 14 wherein said second and third wires are wound coaxially with said core, said coating of insulating material comprising a first layer and a second layer of insulating material, said first layer surrounding said core and first wire, said second wire being wound on said first layer, said second layer surrounding said second wire and said first layer, said third wire being wound on said second layer, and said jacket surrounding said third wire and said second layer.

16. The heating cable of claim 14 wherein said second and third wires comprise a twin lead conductor wherein said second and third wires are insulated and spaced apart by meltable insulating material, said twin lead connector being wound on said first wire with said second and third wire each being disposed in the configuration of a helix with both helices having the same diameter.

17. A heating pad cable and control adapted for operation at a plurality of different wattages comprising an elongated heating cable having a plurality of conductor wires which are coextensive with each other and are maintained in spaced relation by a meltable insulation, said insulation having a melting temperature such that it softens or melts in the event of a temperature rise which would present hazards to the user of said pad, such melting or softening permitting said wires to contact each other, switch means for operating said cable at a plurality of selected wattage levels, said switch means connecting various of said wires to a source of power to obtain said wattage levels, said switch means also connecting at each wattage level two of said wires to said power source one being connected to each of the two sides of the power source to function as sensor wires in the event of overheat conditions, means responsive to current flow in said sensor wires to disconnect said cable from said source in the event of an overheat condition, one of said sensor wires being operative to disconnect said cable if the overheat occurs at one-half of said cable and the other being operative to disconnect said cable if the overheat occurs at the other half of said cable.

18. The combination of claim 17 wherein said means responsive to current flow comprises a thermal fuse connected in series with said cable and a pair of resistors in good heat transfer relation with said fuse, each said resistor being connected to one of said sensor wires between said sensor wire and its connection to the power source.

19. The combination of claim 18 wherein said switch means has at least three operative manually selectable positions in which said wires are connected to said power source to provide three different wattage levels in said cable, said cable includes three wires a first of which is connected as a sensor in all three switch positions, a second of the three wires functions as a heater at two switch positions and having a half-wave rectifier in series with it at one of these switch positions, a third one of said wires functioning as a sensor wire in the two switch positions in which said second wire functions as a heater and functions as a heater in the switch position in which said second wire functions as a sensor.

20. The combination of claim 19 in which the means connecting said first wire to said power source includes a rectifier which limits current flow to the direction from said first wire to said power source.

* * * * *